US006260442B1

(12) United States Patent
Bayat

(10) Patent No.: US 6,260,442 B1
(45) Date of Patent: Jul. 17, 2001

(54) BROKEN LIGHT BULB BASE REMOVER

(75) Inventor: Bijan Bayat, Plano, TX (US)

(73) Assignee: Bayco Products, Inc., Dallas, TX (US)

( * ) Notice: Subject to any disclaimer, the term of this patent is extended or adjusted under 35 U.S.C. 154(b) by 0 days.

(21) Appl. No.: 09/277,036

(22) Filed: Mar. 25, 1999

(51) Int. Cl.[7] ..... H01K 3/32
(52) U.S. Cl. ..... 81/53.11; 81/441
(58) Field of Search ..... 81/53.11, 53.2, 81/441, 442, 489

(56) References Cited

U.S. PATENT DOCUMENTS

| | | | | |
|---|---|---|---|---|
| 1,319,028 | | 10/1919 | Grinnell . | |
| 2,117,017 | | 5/1938 | Chadsey . | |
| 2,516,650 | | 7/1950 | Shapiro et al. . | |
| 3,797,055 | * | 3/1974 | Greene | 7/1 G |
| 4,485,701 | | 12/1984 | Hough . | |
| 5,490,438 | | 2/1996 | Zupo et al. . | |
| 5,617,602 | * | 4/1997 | Okada | 15/22 |
| 5,730,662 | * | 3/1998 | Rens | 473/300 |
| 5,809,850 | * | 9/1998 | Tickner | 81/53.11 |
| 5,829,324 | * | 11/1998 | Secor | 81/53.11 |

* cited by examiner

*Primary Examiner*—Stephen F. Gerrity
*Assistant Examiner*—Hadi Shakeri
(74) *Attorney, Agent, or Firm*—Winstead Sechrest & Minick, PC

(57) ABSTRACT

A tool for removing a broken light bulb base from a socket includes a body member for supporting a tubular resiliently deformable bulb base gripping head member operable to engage a broken bulb base including the glass bulb base portion, if remaining intact with the bulb base, whereby axial and rotational forces exerted by the tool body member effects substantial elastic deformation of the head member into frictional gripping engagement with the base to permit rotation of the base and removal from a socket. The body member includes a rigid tubular support part for engaging one end of the resilient head member but the rigid support part does not engage or enter the bulb base. The tool may be provided with a second resilient head member and supporting body member nestable in the first mentioned body member and usable for smaller diameter broken bulb bases. An adapter part is provided for mounting the tool on the end of an elongated pole for reaching otherwise inaccessible bulbs.

19 Claims, 4 Drawing Sheets

BROKEN LIGHT BULB BASE REMOVER

FIELD OF THE INVENTION

The present invention pertains to a tool for removing the base of a broken incandescent light bulb wherein the tool includes a resilient deformable head member which is adapted to forcibly engage the base of a broken light bulb for rotating the base to disconnect from a socket member.

BACKGROUND

Various tools have been developed for removing the base of a broken incandescent light bulb from a socket member. Prior art broken bulb removal tools have been characterized by substantially rigid bulb base engaging head parts which are adapted to forcibly grip the remaining glass portion of the bulb retained in the base and/or the metal base member after removal of the glass portion. Tools have also been developed wherein a resilient sleeve member is retained on the tool sleeved over a rigid head part wherein the rigid head part also forcibly engages the bulb base with the resilient sleeve member interposed the rigid head part and the broken bulb base. These prior art tools wherein a rigid member forcibly engages the bulb base and extends within the bulb base tend to break up the remaining portion of the glass bulb disposed in the base or intentionally break out the remaining glass portion which is inconvenient and somewhat dangerous since the glass shards must be dealt with. Such prior art tools also often otherwise deform the bulb base structure so that it cannot be suitably removed from the socket.

Accordingly, there has been a continuing need to provide improvements in broken light bulb base removal tools. The present invention addresses problems associated with prior art bulb base removal tools and provides certain sought after improvements in such tools.

SUMMARY OF THE INVENTION

The present invention provides an improved tool for removing a threaded base of a broken incandescent light bulb and the like.

In accordance with one important aspect of the present invention, a broken light bulb base removal tool is provided wherein a tool body is adapted to support a resilient tubular head member operable to be inserted within the base of a broken light bulb and resiliently deflected into forcible engagement with the base while minimizing the chance of damaging the base or breaking the remaining portion of the glass bulb secured in the base for effective removal of the bulb base from a socket.

The resilient tubular head member is provided with a distal end portion which is intersected by a substantial opening therein for receiving a bulb filament and associated support structure which may remain attached to the bulb base. The resilient head member provides suitable clearance for the filament and associated support structure while allowing the resilient head member to be substantially torsionally and axially deflected into forcible engagement with the bulb base whereby rotation of the tool will permit removal of the base from threaded engagement with a bulb receiving socket.

In accordance with another aspect of the present invention, a broken light bulb base removal tool is provided wherein only a resilient flexible tubular head member is deformably engageable with the bulb base to minimize the risk of breakage or damage to the base which might result in the inability to remove the base from a socket member.

In accordance with another aspect of the present invention, a broken light bulb base removal tool is provided which includes two resilient tubular base engaging head members, each suitably retained on a generally elongated cylindrical body member and wherein the body members are nested one within the other and forcibly engaged with each other by cooperating axially extending splines.

Still further, the present invention provides an improved broken light bulb base removal tool which includes an adapter for connecting the tool to an elongated handle or pole for use of the tool in hard to reach or overhead operations for removing broken light bulb bases from bulb receiving sockets. The tool adapter is easily connected to and disconnected from the tool body, as needed.

Those skilled in the art will further appreciate the above-mentioned features and advantages of the invention, together with other important aspects thereof upon reading the detailed description which follows in conjunction with the drawing.

DETAILED DESCRIPTION OF A PREFERRED EMBODIMENT

Figure 1:
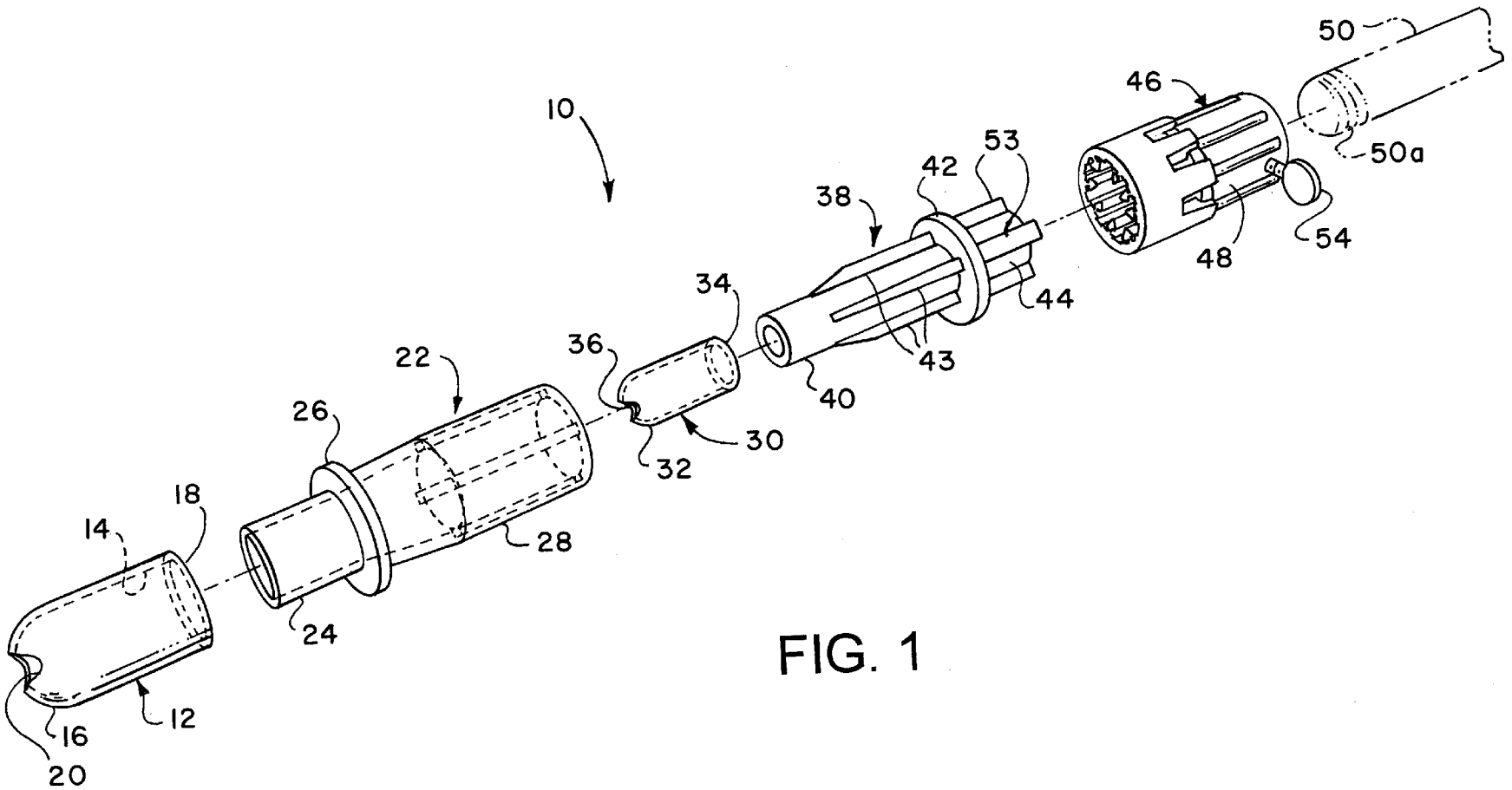
FIG. 1 is an exploded perspective view of a broken light bulb base removal tool in accordance with the present invention.

In the description which follows like parts are marked throughout the specification and drawing with the same reference numerals, respectively. The drawing figures are not necessarily to scale and certain features may be shown in generalized or somewhat schematic form in the interest of clarity and conciseness.

Referring to FIG. 1, there is illustrated a broken light bulb base removal tool in accordance with the invention and generally designated by the numeral 10. The tool 10 includes a resilient, tubular, deformable light bulb base engaging head member 12 having an internal bore 14 delimited by a relatively thin walled cylindrical tube or sheath having a generally arcuate, preferably hemispherical, bulb base engaging distal end 16 and a second end 18. The bulb base engaging end 16 is delimited by a central opening 20 for receiving bulb filaments and filament support structure which may remain connected to the remainder of a bulb base after the main portion of the bulb has been broken away. The resilient head member 12 is preferably formed of a suitable elastomer, such as silicone rubber or EPDM compounds, for example, having a hardness of about 65 durometer.

The head member 12 is adapted to be mounted on a generally cylindrical tubular body member 22 having a cylindrical head supporting end part 24 contiguous with a transverse circular flange 26 which is also contiguous with a larger diameter cylindrical body part 28. The outer diameter of the head support part 24 is slightly larger than the nominal diameter of the bore 14 so that the head member 12 is force-fitted over the support part 24 and suitably retained in engagement therewith and non-rotatable or axially movable relative to the support part during normal operation of the tool 10.

The tool 10 preferably includes a second resilient deformable tubular head member 30 which is configured substantially like the head member 12 but is of smaller diameter and includes a somewhat arcuate, preferably hemispherical, distal end 32 opposite a second end 34. Hemispherical end 32 is delimited by a central opening 36 also adapted to provide clearance for the filament and/or filament support structure of a broken light bulb. The resilient deformable head member 30 may also be formed of a molded or extruded elastomer material, such as silicone rubber, having a hardness of about 65 durometer, for example. A second body part 38 for supporting the head member 30 comprises an elongated tubular head supporting end part 40 contiguous with a transverse circular flange 42. A second part 44 of the body member 38 extends from flange 42 opposite the part 40. The tool 10 is further, preferably, provided with an adapter 46 comprising a generally cylindrical tubular part 48 which is internally threaded for receiving an externally threaded end 50*a* of an extension handle or pole 50, for example. The body parts 22 and 38 and the adapter 46 are preferably molded of a suitable polymer material, such as polypropylene, for example.

Figure 2:
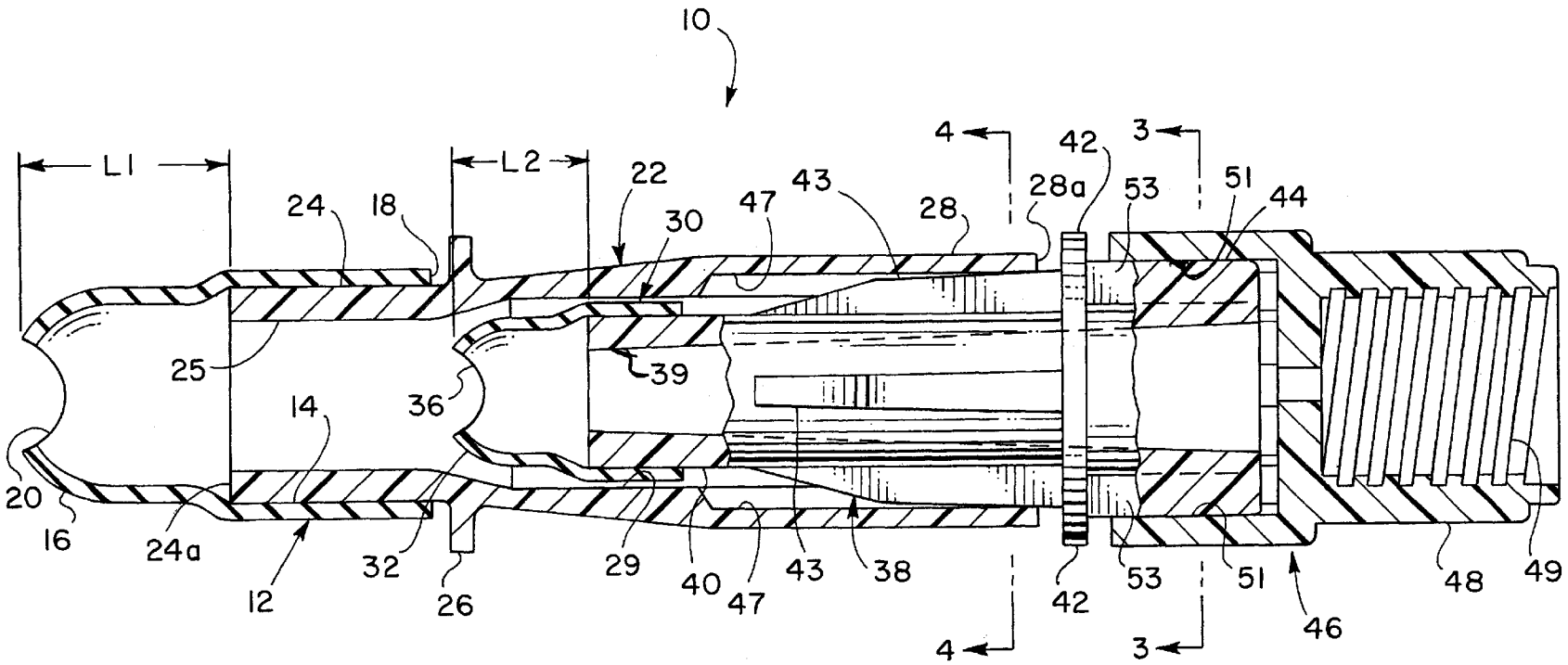
FIG. 2 is a longitudinal central section view of the tool shown in FIG. 1 and shown in an assembled condition.
Figure 3:
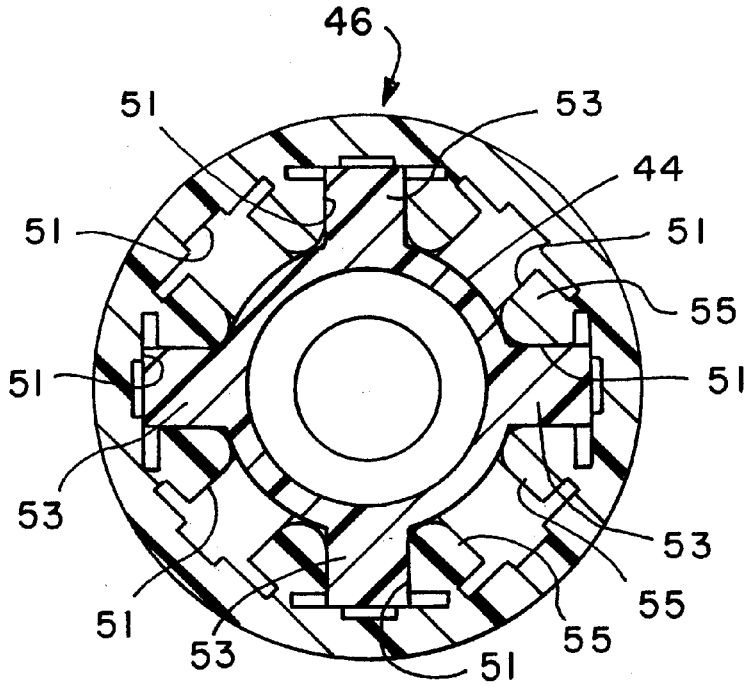
FIG. 3 is a section view taken along the line 3—3 of FIG. 2.
Figure 4:
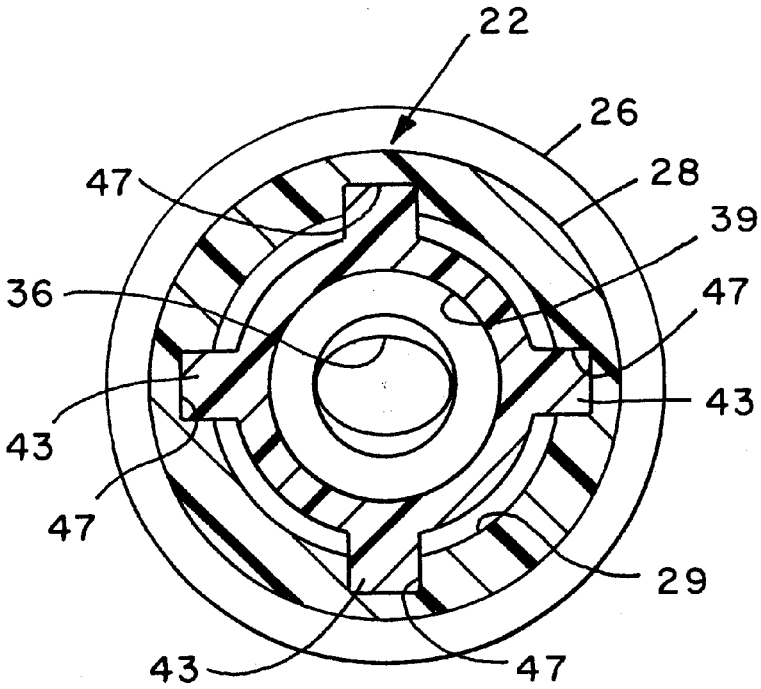
FIG. 4 is a section view taken along the line 4—4 of FIG. 2.

Referring now to FIGS. 2, 3 and 4, the broken bulb base removal tool 10 is shown in an assembled condition wherein the resilient deformable head member 12 is sleeved over the support part 24 and retained in forcible engagement therewith. As shown in FIG. 2, the body part 22 includes a central bore 25 opening to distal end 24*a* of the support part 24 and being of sufficient diameter to allow insertion of a lamp bulb filament and/or filament support structure within the tool 10 through the opening 20, for example. The flange 26 is provided to form a stop if the body member 22 is grasped manually to rotate a broken bulb base to prevent one's fingers from slipping axially toward a broken bulb beyond the flange. The body member 22 also includes an enlarged axial bore 29 for receiving the head member 30 and its support body member 38 in nested relationship within the body member 22.

As further shown in FIG. 2, the body member 38 includes a central bore 39 at least as large in diameter, approximately, as the opening 36 in the deformable head member 30 and the head member 30 is shown force fitted over the tubular support part 40 and retained thereon in the same manner that the head member 12 is retained on the support part 24. As shown in FIGS. 2 and 4, the body member 38 is provided with a plurality of circumferentially spaced axially extending tapered splines 43 which are adapted to fit in cooperating axial grooves 47 formed in the part 28 of body member 22. The splines 43 are axially tapered, as shown in FIG. 2, so that the splines tend to wedge into the axially extending grooves 47 to retain the body members 22 and 38 assembled to each other, as shown. The splines 43 and grooves 47 are dimensioned such that the distal end 28*a* of body member 22 does not engage flange 42 when the body members 22 and 38 are assembled to each other. In this way, if the two body members 22 and 38 become too tightly wedged together a suitable tool may be inserted between the flange 42 and the distal end 28*a* to forcibly separate the members from each other.

Referring further to FIGS. 2 and 3, the adapter 46 is provided with plural circumferentially spaced radially extending grooves 51, FIG. 3, for receiving cooperating axially extending circumferentially spaced key parts 53 integrally formed on the body part 44. The dimensions of the grooves 51, as well as the key parts 53, are such that the key parts are a mild force fit in the grooves and by providing plural ones of grooves 51 interposed the grooves which receive the key parts 53 the wall portions 55 interposed adjacent grooves are elastically deformable to allow insertion of the key parts within the grooves and forcibly retain the adapter 46 connected to the body member 38. As shown in FIG. 1, the adapter 46 is provided with a retainer pin 54 suitably threadedly engaged in a bore formed in the adapter part 48 intersecting a bore formed in part 48 and operable to retain handle or pole 50, for example, threadedly engaged with the adapter 46. Internal threads 49, FIG. 2, are formed in the adapter part 48, as shown.

One particular advantage of the tool 10, including the resilient head members 12 and 30 and their respective nestable body members, is that only the resilient head members are forcibly engageable with a broken bulb base, thanks to substantial portions of the head members, respectively, which are unsupported by the body parts 24 and 40, for example. This relationship may be appreciated by viewing FIG. 2 wherein the assembled positions of the head members 12 and 30 on their respective support body members 22 and 38 is illustrated. The lengths L1 and L2 of the respective cylindrical tubular head members 12 and 30 which are unsupported by the body members 22 and 38, respectively, are preferably at least as great as the nominal outside diameters of the head members and may be about 1.0 to 1.5 times the nominal outside diameters of the resilient head members. The nominal outside diameters of the head members 12 and 30 are approximately the same as the nominal thread root diameter of a conventional incandescent bulb base for bulbs having threaded base members, such as typical household 120 volt AC incandescent light bulbs.

Figure 5:
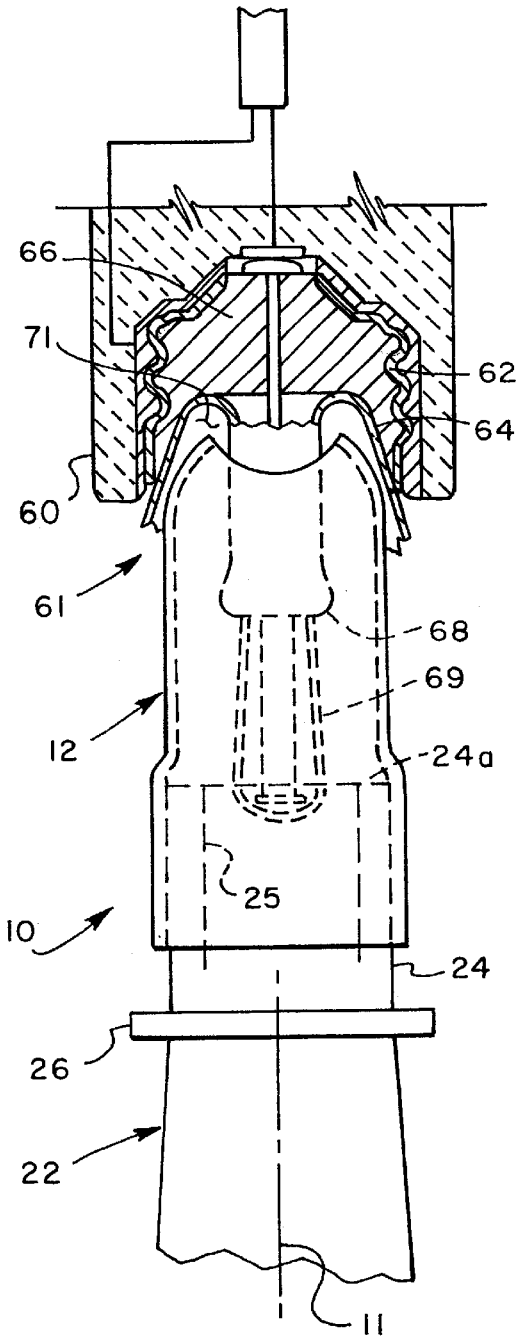
FIG. 5 is a view showing a position of the tool of the present invention about to engage the base of a broken light bulb.
Figure 6:
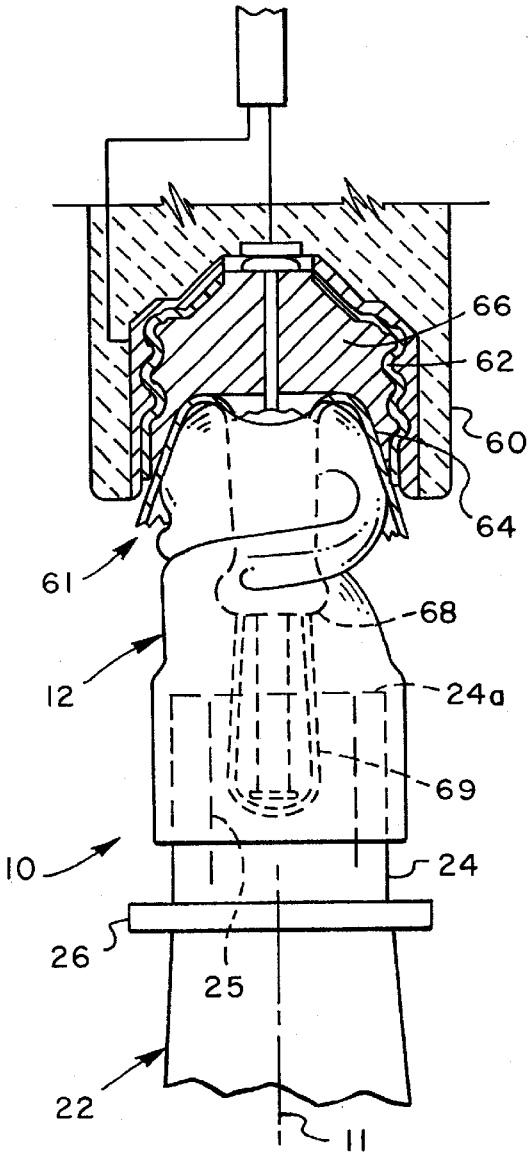
FIG. 6 is a view similar to FIG. 5 showing the tool fully engaged with the broken light bulb base.

Referring now to FIGS. 5 and 6, for example, there is illustrated a socket member 60 for receiving a conventional 120 volt AC incandescent light bulb 61, shown broken, and including a base 62 having conventional threads formed thereon and being of formed tubular metal construction, as illustrated. In FIG. 5, the base part 64 of a broken glass bulb is shown assembled to the threaded base 62 and secured thereto by a suitable nonconductive adhesive and potting composition 66, for example. In the exemplary arrangement shown in FIG. 5, the lamp or light bulb 61 is broken such that the bulb base portion 64 remains intact, as is a common occurrence, and a filament support post 68, normally formed integral with the bulb base portion 64 is also still intact, is shown disposed within the opening 20 of the head member 12, extends substantially therewithin and may extend within the bore 25 formed in the body member 22.

Referring also to FIG. 6, after the head member 12 has been moved into the position shown in FIG. 5 with the remaining bulb filament 69 and filament support structure 68, if any, still connected to the base 62, the tool 10 is moved further axially toward the base 62 so that the head member 12 is axially deformed as shown in FIG. 6 and fills, substantially, the cavity 71, FIG. 5, provided by the remainder of the bulb base 64 which has not broken away.

As the tool 10 is rotated about longitudinal central axis 11 in the direction which will normally disengage the threaded base 62 from the socket 60, the resilient head member 12 will torsionally deform, as shown in FIG. 6, and as axial force is applied to the tool 10 toward the base 62, the head member 12 will frictionally grip the bulb base 64 and substantially continue to fill the cavity 71 without tending to damage the base 62 or breakaway the glass bulb base portion 64, as is typical of broken bulb base removal tools which have a rigid head portion engageable with the bulb base.

Accordingly, as the tool 10 is applied axially to the bulb base 62 and forcibly engaged both axially and rotationally with the glass bulb portion base 64, the large areal distribution of forces acting on the base 62, including the glass bulb base portion 64, if any of such glass bulb portion remains in the base, will tend not to deform or damage the base 62 or breakaway the glass bulb base portion 64 still remaining intact, and including the filament support structure 68, so that a firm grip may be applied to the bulb base 62 and the base rotated out of engagement with the socket 60. This advantage is achieved by avoiding contact with or forcible entry of any part of the rigid body member 12 into the base 62, including the bulb base portion 64. In this way the bulb base of a broken incandescent light bulb 61, or the like, may be more easily removed from a socket or similar support structure than has been achievable with prior art broken bulb base removal tools. Once the bulb base 62 is loosened and removed from the socket 60, the bulb base will tend to remain engaged with the tool 10, particularly if the filament 69 or the filament support post 68, or similar structure remains intact with the bulb base and disposed within the opening 20. The head member 12 is preferably provided with an elastic memory which causes the head member to restore to the cylindrical tubular shape shown in FIGS. 1, 2 and 5 when disengaged from a bulb base. If the head member 12 becomes worn or damaged, it may be easily removed from body member 22 and replaced.

For light bulbs of smaller sizes, the tool 10 may be partially disassembled by removing the body member 22 together with the head member 12 in assembly therewith from the body member 38 in assembly with the head member 30 and the tool using only the head member 30 and body member 38 may be operated to remove a smaller diameter bulb base in substantially the same manner as described above. The tool 10 may, of course, be used with or without the adapter part 46 connected to the body member 38.

Thanks to the nestable arrangement of the body members 22 and 38, a universal tool is provided for removing broken bases of various light bulbs over a relatively wide range of bulb sizes. Again, an important advantage of the tool 10 is that neither of the head members 12 or 30, when the tool is engaged with a broken bulb base, will tend to damage the bulb base in such a way that it cannot be removed from the socket nor will the head members likely break any of the remaining glass bulb base portion retained in the bulb base.

Although a preferred embodiment of the invention has been described in detail herein, those skilled in the art will recognize that various substitutions and modifications may be made to the broken light bulb base removal tool of the invention without departing from the scope and spirit of the appended claims.

What is claimed is:

1. A tool for removing a broken light bulb base from a socket, said tool comprising:

a body member having a first part for supporting a resilient head member; and a resilient head member having a proximal end portion that grips said first part of said body member, a distal end portion engageable with a broken light bulb base, and an intermediate portion between the proximal and distal end portions, said distal end portion and said intermediate portion of said head member having a length that is unsupported by said body member such that said body member is located outside of said broken light bulb base when said head member is fully inserted into said broken light bulb base for removal of said broken light bulb base from said socket, said distal end portion of said head member being deformable to substantially fill a cavity formed in said broken light bulb base and to forcibly engage said broken light bulb base in response to axial and rotational movement of said body member, said intermediate portion being torsionally deformable in response to the rotational movement of said body member to thereby effect rotation of said broken light bulb base after commencement of said rotational movement of said body member to remove said broken light bulb base from said socket.

2. The tool set forth in claim 1 wherein:

said distal end of said head member includes an opening formed therein for receiving a bulb filament and/or filament support structure therein to permit insertion of said distal end of said head member into said cavity formed by said light bulb base and in forcible engagement with said light bulb base.

3. The tool set forth in claim 1 wherein:

said fist part of said body member includes a generally tubular end part adapted to receive said head member in sleeved relationship thereover and in forcible engagement therewith whereby said body member and said head member are nonrotatable relative to each other.

4. The tool set forth in claim 3 including:

a transverse flange formed on said body member between a part of said body member and said end part.

5. The tool set forth in claim 3 wherein:

said body member has a hollow body part for receiving a second body member supporting a second resilient deformable head member for engaging a broken bulb base of a smaller diameter.

6. The tool set forth in claim 5 wherein:

said body members are engageable with each other for rotation with each other by cooperating axially extending splines and grooves on said body members, respectively.

7. The tool set forth in claim 6 wherein:

said cooperating splines and grooves on said body members are dimensioned to provide an axial force fit between said body members to retain said body members assembled with each other.

8. The tool set forth in claim 5 wherein:

said tool includes an adapter part engageable with one of said body members, said adapter part including a portion for engagement with an elongated pole whereby said tool may be mounted on an end of said pole for engagement with broken light bulb bases which are relatively inaccessible.

9. The tool set forth in claim 8 wherein:

said adapter part and said one body member are connected to each other by cooperating grooves and key portions formed on said adapter part and said one body member, respectively.

10. The tool set forth in claim 1 wherein:

said distal end portion of said head member has a substantially hemispherical shape.

11. The tool set forth in claim 1 wherein:

said head member has a generally tubular shape and is formed of a material having an elastic memory which restores said head member to the generally tubular shape upon disengagement of said head member from said broken light bulb base.

12. The tool set forth in claim 11 wherein:

said head member is formed of a material selected from a group consisting of silicone rubber and EPDM compounds.

13. The tool set forth in claim 1 wherein:

said length that is unsupported by said body member is no less than an outer diameter of said head member.

14. A tool for removing a broken light bulb base from a socket, said tool comprising:

a first body member having a support part for supporting a first head member thereon;

a first resilient head member having a proximal end portion that grips said support part of said first body member, a distal end portion engageable with a broken light bulb base, and an intermediate portion between the proximal and end portions, said distal end portion and said intermediate portion of said head member having a length that is unsupported by said body member such that said body member is located outside of said broken light bulb base when said head member is fully inserted into said broken light bulb base for removal of said broken light bulb base from said socket, said distal end portion of said first head member being deformable to substantially fill a cavity formed in said broken light bulb base and to forcibly engage said broken light bulb base in response to axial and rotational movement of said first body member, said intermediate portion being torsionally deformable in response to the rotational movement of the first body member to thereby effect rotation of said broken light bulb base after commencement of said rotational movement of said first body member to remove said broken light bulb base from said socket;

a second body member releasably connectable to said first body member and including a second support part for supporting a second head member;

a second deformable head member mounted on said second body member for engaging a broken light bulb base of a smaller diameter than said first head member; and said second head member and said second body member being at least partially nestable in a bore formed by said first body member.

15. The tool set forth in claim 14 wherein:

said body members are engageable with each other for rotation with each other by cooperating axially extending splines and grooves on said body members, respectively.

16. The tool set forth in claim 15 wherein:

said cooperating splines and grooves on said body members are dimensioned to provide an axial force fit between said body members to retain said body members assembled with each other.

17. The tool set forth in claim 15 including:

an adapter part engageable with one of said body members, said adapter part including a portion for engagement with an elongated pole whereby said tool may be mounted on an end of said pole for engagement with broken light bulb bases which are relatively inaccessible.

18. The tool set forth in claim 17 wherein:

said adapter part and said one body member are connected to each other by cooperating grooves and key portions formed on said adapter part and said one body member, respectively.

19. A tool for removing a broken light bulb base from a socket, said tool comprising:

a body member having a first part for supporting a resilient head member;

a resilient head member connected to said body member and having a proximal end portion that grips said first part of said body member, a distal end portion engageable with a broken light bulb base, and an intermediate portion between the proximal and distal end portions, said head member being adapted to forcibly engage said light bulb base in response to axial and rotational movement of said body member to thereby effect rotation of said broken light bulb base and thus removal of said broken light bulb base from said socket; and said distal end portion and said intermediate portion of said head member having a length that is unsupported by said body member such that said body member is located outside of said broken light bulb base when said head member is fully inserted into said broken light bulb base for removal of said broken light bulb base from said socket.

* * * * *